US006898862B1

(12) United States Patent
Oberst

(10) Patent No.: US 6,898,862 B1
(45) Date of Patent: May 31, 2005

(54) LOCATOR FOR HANGING PICTURE FRAMES

(76) Inventor: E. Ernest Oberst, 404 Patton Dr., Cheshire, CT (US) 06510

( * ) Notice: Subject to any disclaimer, the term of this patent is extended or adjusted under 35 U.S.C. 154(b) by 0 days.

(21) Appl. No.: 10/436,900

(22) Filed: May 13, 2003

(51) Int. Cl.[7] ..... G01B 3/02; G01D 21/00

(52) U.S. Cl. ..... 33/613; 33/666; 33/644; 33/574

(58) Field of Search ..... 33/613, 18.1, 644–645, 33/666, 669, 677–679, 427, 464, 474, 451, 483–485, 493–495, 577, 574, 465, 452, 482

(56) References Cited

U.S. PATENT DOCUMENTS 3,955,790 A * 5/1976 Ballin ..... 33/354
4,455,756 A * 6/1984 Greene ..... 33/613
4,485,561 A * 12/1984 Hopkins, Sr. ..... 33/574
4,649,652 A * 3/1987 Dickinson et al. ..... 33/669
4,753,014 A * 6/1988 Vrajich ..... 33/613
4,893,776 A * 1/1990 Floyd ..... 33/666
5,129,154 A * 7/1992 Aydelott ..... 33/613
5,471,760 A * 12/1995 Farris ..... 33/613
5,509,213 A * 4/1996 Kelly et al. ..... 33/613
6,026,584 A * 2/2000 Wegman ..... 33/613
6,739,065 B2 * 5/2004 Hofmeister et al. ..... 33/613
2004/0177527 A1 * 9/2004 Prevost ..... 33/613

* cited by examiner

*Primary Examiner*—Christopher W. Fulton
*Assistant Examiner*—Yaritza Guadalupe
(74) *Attorney, Agent, or Firm*—Alix, Yale & Ristas, LLP

(57) ABSTRACT

A locator for hanging picture frames employs an arm which has a handle dispose at one end. A suspension/marker assembly is carried at a second position of the arm. The suspension/marker assembly comprises a plunger which has a point and also mounts a head which receives a frame hanger. Embodiments are disclosed for both a single mount and for a single or a dual mount application.

21 Claims, 7 Drawing Sheets

LOCATOR FOR HANGING PICTURE FRAMES

BACKGROUND OF THE INVENTION

This invention relates generally to devices and techniques which facilitate the hanging of picture frames and the like. More particularly, this invention relates to devices which aid in the proper positioning of the picture frame.

One of the most common household tasks is to hang a picture frame in the proper location and the proper orientation. Typically, a screw, nail or hook with a fastener is mounted to the wall. The back of the frame includes a picture frame wire or other hanger of various functions and forms which is then engaged with the mounted hardware fastener. The precise positioning of the nail, screw or hook is always highly problematic since it is extremely difficult to precisely locate same. Conventionally, the mounting hardware is obstructed by the picture frame when a trial position is attempted and the ultimate hanging relationship is not easily replicated. For large pictures where two suspension points are desired, it becomes quite problematic to properly align the two points for positioning the mounting support.

It is well known that one common technique is to essentially guess at the proper position and mark the position more or less with a pencil with the position being essentially blindly marked so that the location of the fastener can be approximated. The problems are also compounded by the difficulties in assessing the proper tensioning on flexible picture frame wires when the weight of a picture frame and the engagement with the wall is finalized. The present invention is a locator used for hanging a picture frame which makes the foregoing positioning process much more precise, predictable and easy.

SUMMARY OF THE INVENTION

Briefly stated, the invention in a preferred form is a locator device for locating the proper anchor position for hanging a frame. The locator device in one embodiment is adaptable for use with a single anchor mount application and in another embodiment is adaptable for both single and dual frame anchor mounts.

The locator device comprises an elongated arm having longitudinally spaced first and second positions. A handle which may be a rod-like member projects orthogonally from the first position. A suspension/marker assembly is disposed at the second position. The suspension/marker assembly comprises a marker and a head for receiving a frame hanger. The assembly comprises a plunger having opposed first and second ends with the head being mounted at the first end and the second end having a pointed configuration. The head has a groove for receiving the frame hanger. The arm further has a bore which receives a portion of the plunger with the plunger point configuration being retracted within the bore in a normal mode and being projectable to extend beyond the bore to mark the proper anchor mount location. A pad may also be mounted to the surface arm at a position generally opposite the head.

The locator device in a second embodiment comprises a first arm having a first boss for suspending a frame hanger and a first marker positioned in close proximity to the first boss. The second arm has a second boss for suspending the frame hanger and la second marker positioned in close proximity to the second boss. A connector connects the arms at a selected fixed angular relationship. The connector may comprise a threaded fastener extending through end locations of the arms and preferably has a wing nut threadable with a fastener. A handle is connected by the connector to the arms and is also positionable in a fixed angular relationship with respect to the arms. The handle further comprises a plate-like member which defines an opening to facilitate holding by the fingers. The handle may also have a second opening, and the handle is positioned between the first and second arms wherein a fastener extends through the arms and the connector.

The marker preferably takes the form of a plunger having a point which is projectable beyond the boss. In one form of the invention, the point is formed from lead. A pad is mounted on an end of the plunger opposite the point. The boss also preferably comprises a central bore which receives the plunger assembly. In a normal mode, the pointer is retracted within the boss. In an activated mode, the plunger extends beyond the boss. The bosses and markers are preferably substantially identical.

The first and second arms form a vertex with the connector being disposed at the vertex, and the markers are disposed generally opposite the vertex to facilitate precisely locating two anchor points for the hanger frame. In this regard, the boss preferably defines a generally arcuate groove for receiving the frame hanger. It should be appreciated that either one or both arms may be employed depending on whether it is desired to locate a single anchor point or dual anchor points.

The locator device is configured so that the frame may be suspended from the locator device, and when the proper position is determined, the frame is slightly depressed against the plunger assembly to force the markers to project from the boss to mark the proper locations on the wall or mounting surface.

An object of the invention is to provide a new and improved locator for use in hanging a picture frame which eliminates many of the drawbacks and problems with conventional hanging techniques.

An object of the invention is to provide a new and improved tool for facilitating the hanging of a picture.

A further object of the invention is to provide a new and improved tool which precisely locates the proper position of the picture hanger in an efficient and highly reliable manner.

Another object of the invention is to provide a new and improved hanger for a picture frame which eliminates guesswork in properly locating the position for a picture frame fastener.

A further object of one embodiment of the invention is to provide a new and improved tool for hanging picture frames which is readily adjustable to provide the proper position for either a single or a multiple mounting support.

Other objects and advantages of the invention will become apparent from the drawings and the detailed description.

DETAILED DESCRIPTION OF THE PREFERRED EMBODIMENTS

Figure 5:
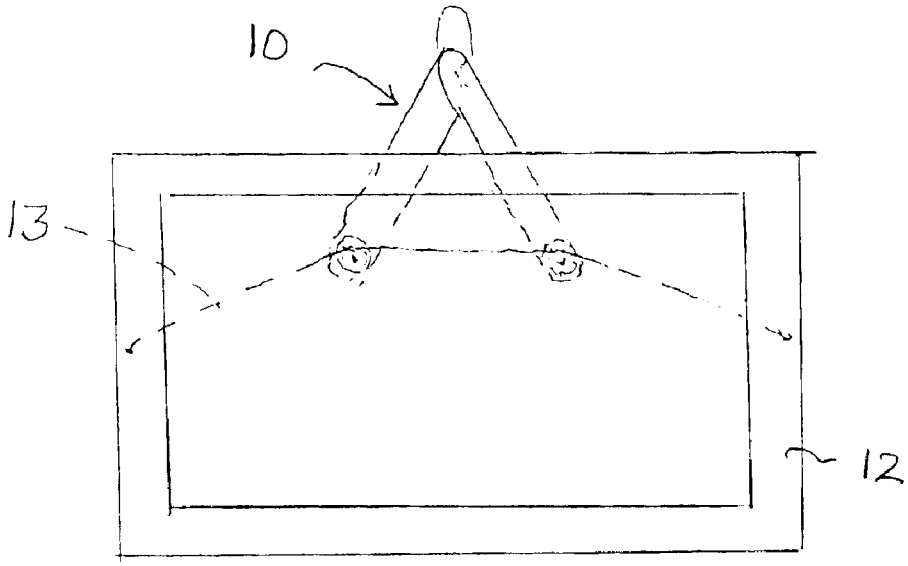
FIG. 5 is a front view, partly in schematic and partly shown in broken lines, illustrating the use of the locator of FIG. 1 for hanging a picture.
Figure 6:
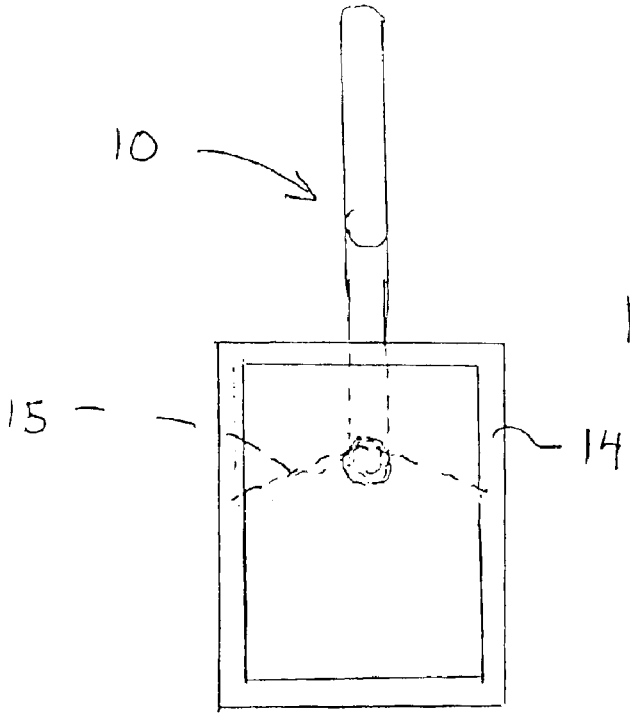
FIG. 6 is a front view, partly in schematic and partly in broken lines, illustrating a second mode for hanging a picture using the locator of FIG. 6.
Figure 7:
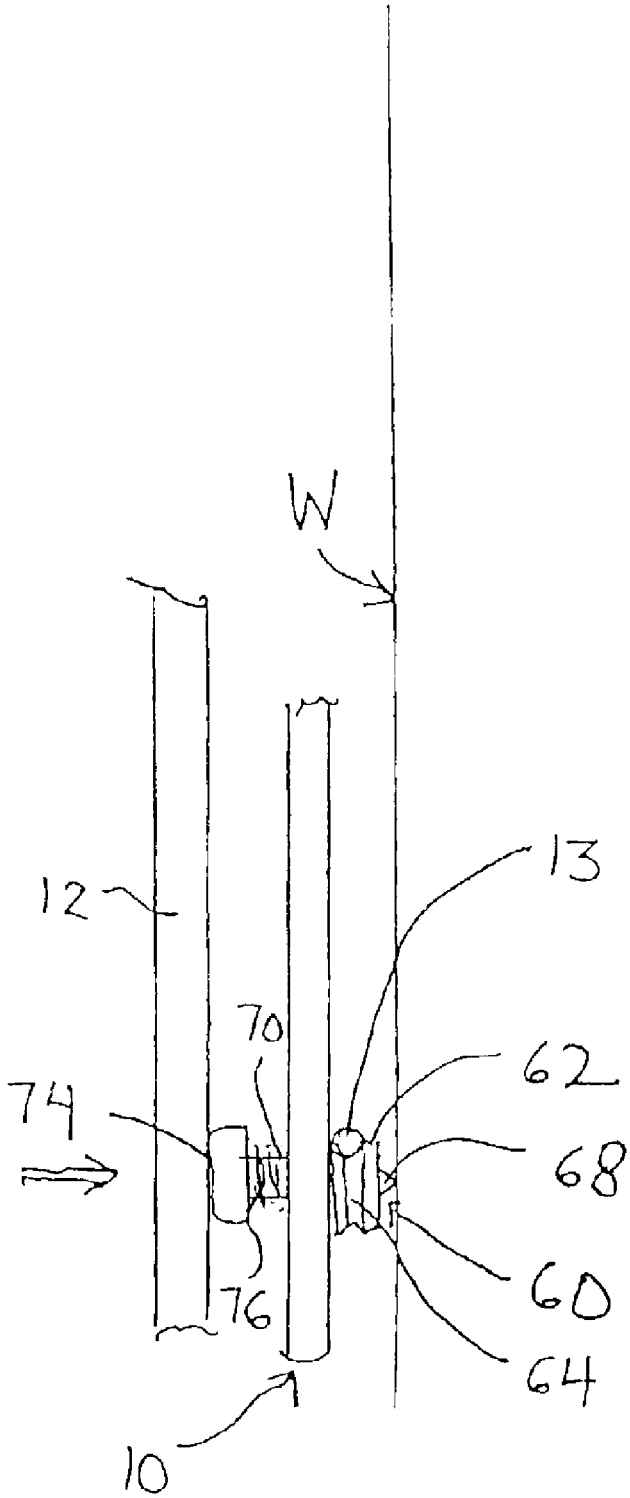
FIG. 7 is a side sectional view, illustrating the relationship between the wall and locator and a picture frame for the locator of FIG. 1, which is partially illustrated.

With reference to the drawings wherein like numerals represent like parts throughout the figures, a locator for use in hanging picture frames and similar items is designated generally by the numeral 10. The locator 10 facilitates the hanging of picture frames 12, 14 by properly locating the proper position for the nail, screw, hook or other anchoring fastener (not illustrated) which is to be fixed to the wall W or support structure for suspending the frame. As illustrated in FIGS. 5, 6 and 7, the locator 10 functions to replicate the suspended configuration of the picture frame/hanger and to precisely locate the picture in a precise position for either a single (FIG. 6) or dual anchoring (FIG. 7) mount. It will be appreciated that for the dual anchor mount, the locator also aides in the proper horizontal alignment of the mounting hardware.

Figure 1:
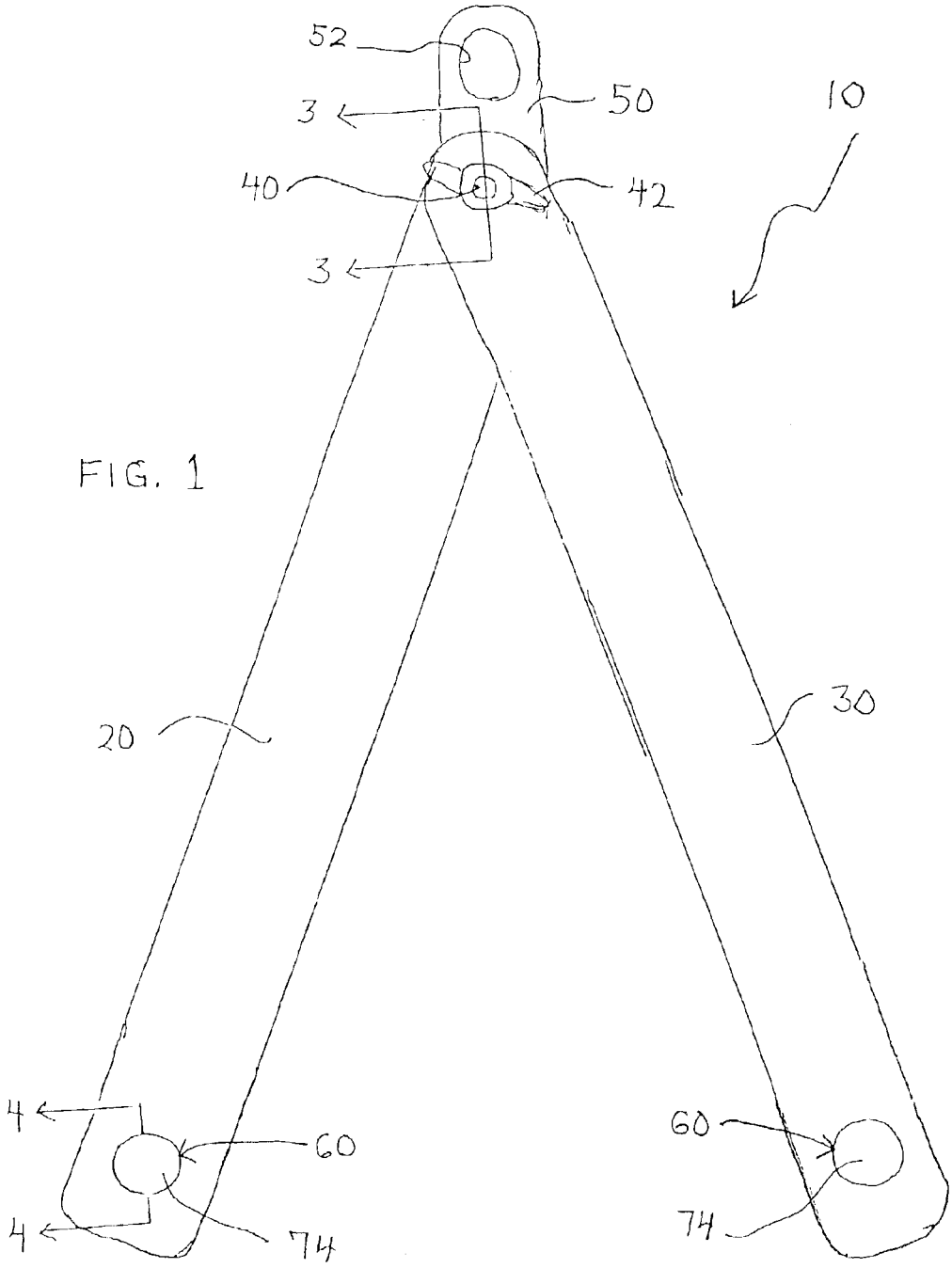
FIG. 1 is a front view of a picture frame hanger locator illustrating the locator in a position for locating a pair of mounts.
Figure 2:
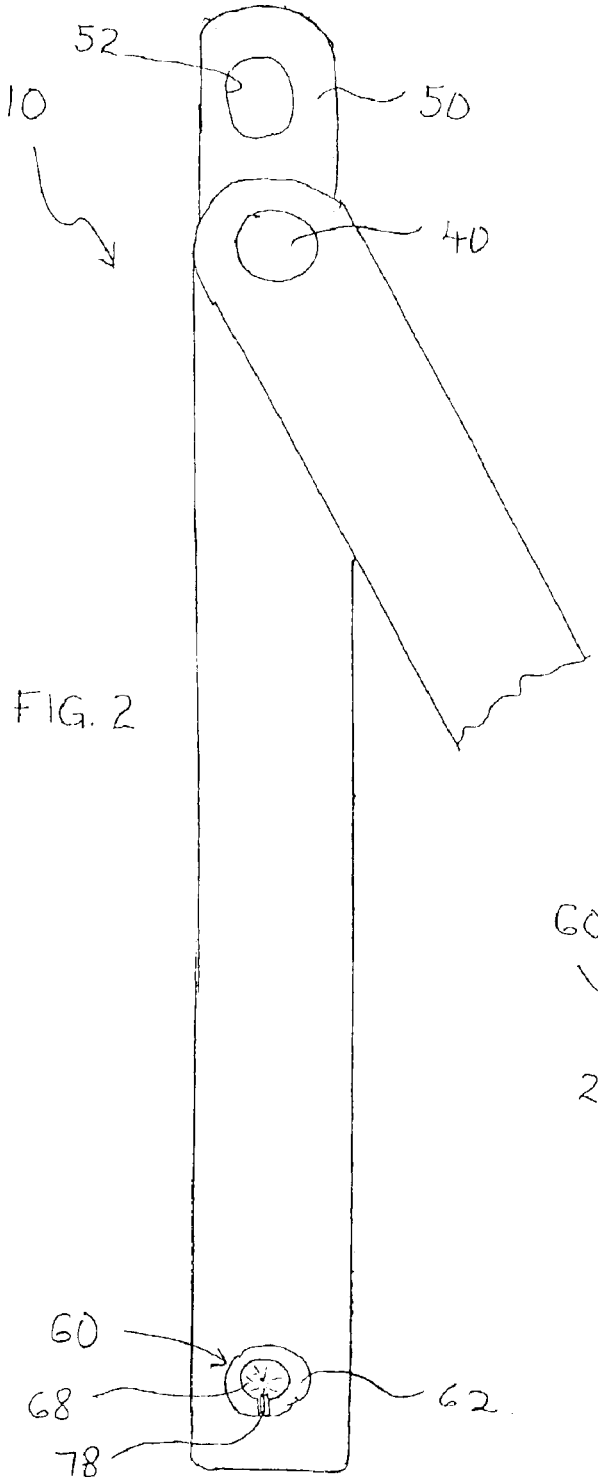
FIG. 2 is a rear view of the picture hanger locator of FIG. 1, illustrating the locator for locating a single mount, portions being broken away and portions shown in phantom.
Figure 3:
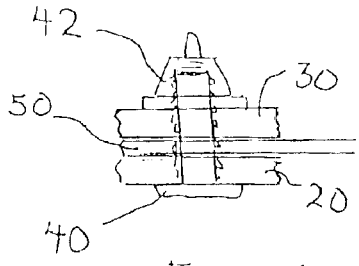
FIG. 3 is a side sectional view of the picture hanger locator of FIG. 1 taken along the line 3—3 thereof.

The locator 10 comprises a pair of pivotally connected elongated arms 20 and 30. The arms are joined by a wing nut 42 which threads against a bolt 40. A hanger 50 is disposed between the ends of the arms 20 and 30 and is also pivotally joined therewith. The hanger 50 preferably includes an opening 52 or other contoured surface to allow sufficient grasping with a finger to allow a suspension therebelow. It will be appreciated that the arms 20, 30 and the handle 50 are adjustable to form a fixed relationship at any of a wide range of angles. The wing nut 42 is then tightened to provide the desired configuration. For a dual mount location configuration as illustrated in FIGS. 1 and 5, the arms 20, 30 form an inverted V-shaped configuration. For a single mount configuration, the arm 30 may be pivoted away or in a linear configuration such as illustrated in FIGS. 2 and 6.

Figure 4:
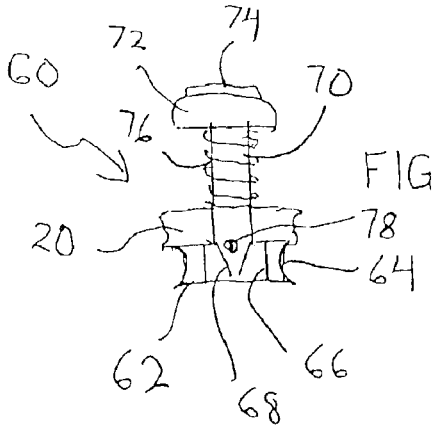
FIG. 4 is a side sectional view of the picture hanger locator of FIG. 1 taken along the line 4—4 thereof.

Each arm carries a selectively projectable marker assembly 60 which is best illustrated in FIG. 4. The rear side of each arm includes a boss 62 with a circumferential groove 64, which is contoured to receive the wire hanger 13, 15 of the associated picture frame 12, 14. The boss 62 forms an interior cavity 66 which, in a normal mode, receives a pointed tip 68 of a plunger 70. The plunger 70 includes a head 72 with a pad 74 at the frontal side of the arm. A spring 76 is disposed between the underside of the head and the arm to urge the pointer to the retracted position illustrated in FIG. 4. A pin 78 may be threaded through the end of the plunger to retain same to the arm. The tip 68 of the plunger may be in the form of a lead point, or may merely be a sharp point which will place a mark or depression in the support surface W when it is depressably projected through the cavity 66. The tip 68 may alternatively be covered with a marking substance to facilitate marking for example, the tip 68 may be depressed and brought into contact or rubbed with a crayon or graphite may be applied.

Figure 8:
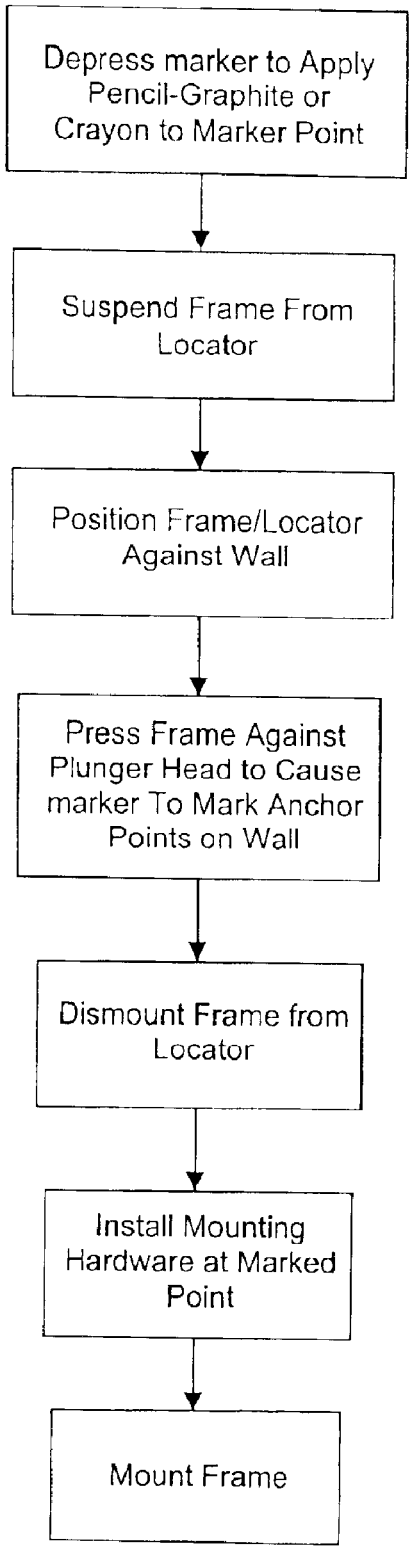
FIG. 8 is a diagram illustrating a method for mounting a picture frame using the locator of FIG. 1.

As best illustrated in FIGS. 5–7 and described in the diagram of FIG. 8, a picture frame 12 or 14 is suspended from the locator by means of the picture frame wire 13 or 15 being positioned in the groove 64 on the top of the boss 62 with the head pad 74 being disposed against the back of the frame and the boss 62 being disposed against the wall W or the support surface. The installer then grasps the hanger 50 and moves the locator with the suspended picture frame to the proper position. When the proper positioning is obtained, a light force is transmitted against the frame in the direction of the FIG. 7 arrow to project the point 68 to mark the proper position on the wall. It will be appreciated that the hanger 10 may be suitably adjusted (by angular positioning of arms 20 and 30) and the frame suspended for either a single (FIG. 5) or a double point (FIG. 6) location.

After the position has been properly marked, the picture frame is then dismounted from the locator and the fastener is positioned at the properly marked point, for example, a screw, nail or other hook type fastener may then be mounted to the wall. The picture frame may be then suspended from the fastener and will accurately replicate the position previously marked on the wall. It will be appreciated that the suspension configuration of the picture will be replicated and that the precise location for the anchoring point will be determined by the locator 10.

Figure 9:
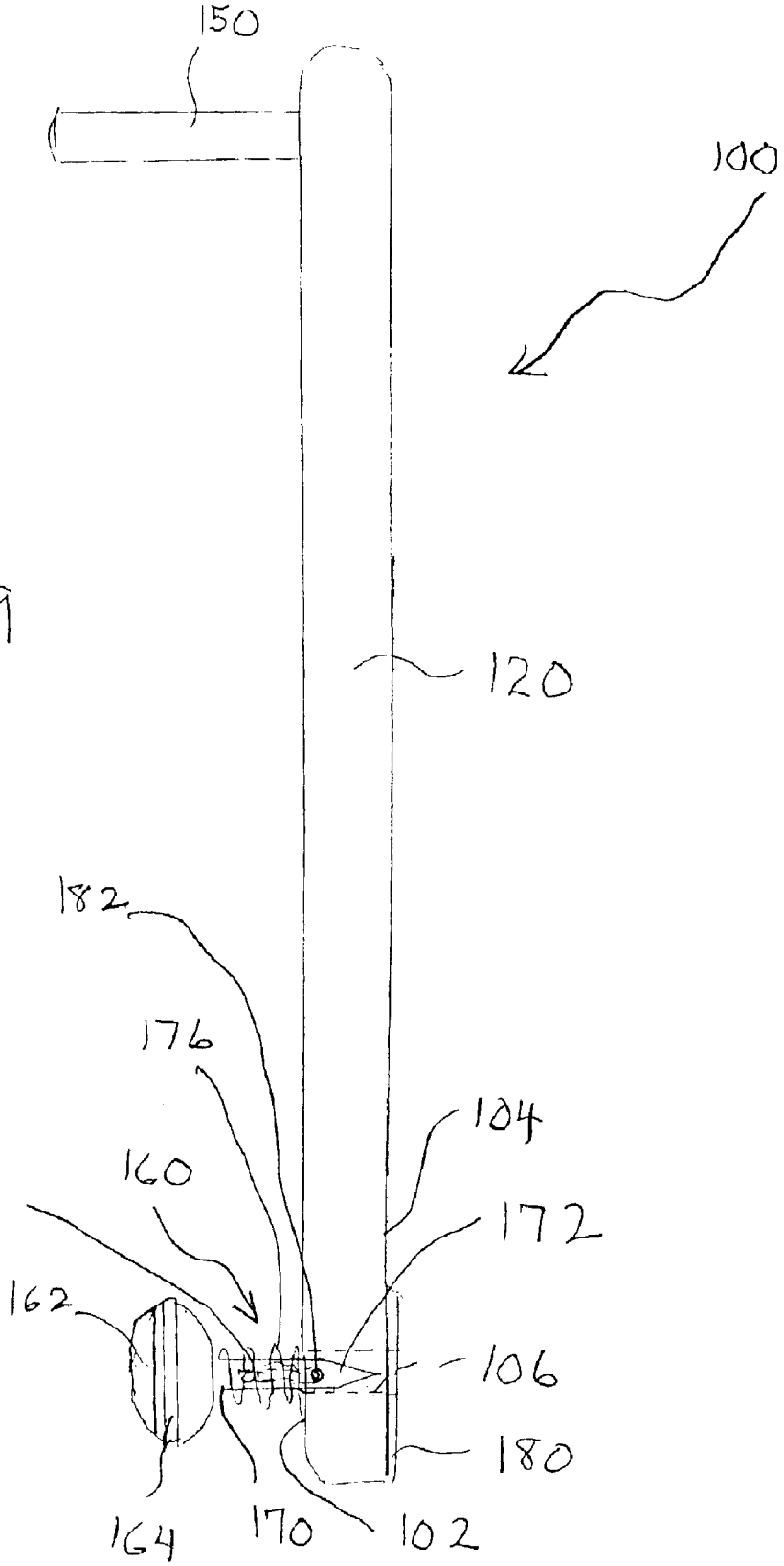
FIG. 9 is a side view, partly broken away and partly in section of another embodiment of a picture frame hanger locator in accordance with the present invention.
Figure 10:
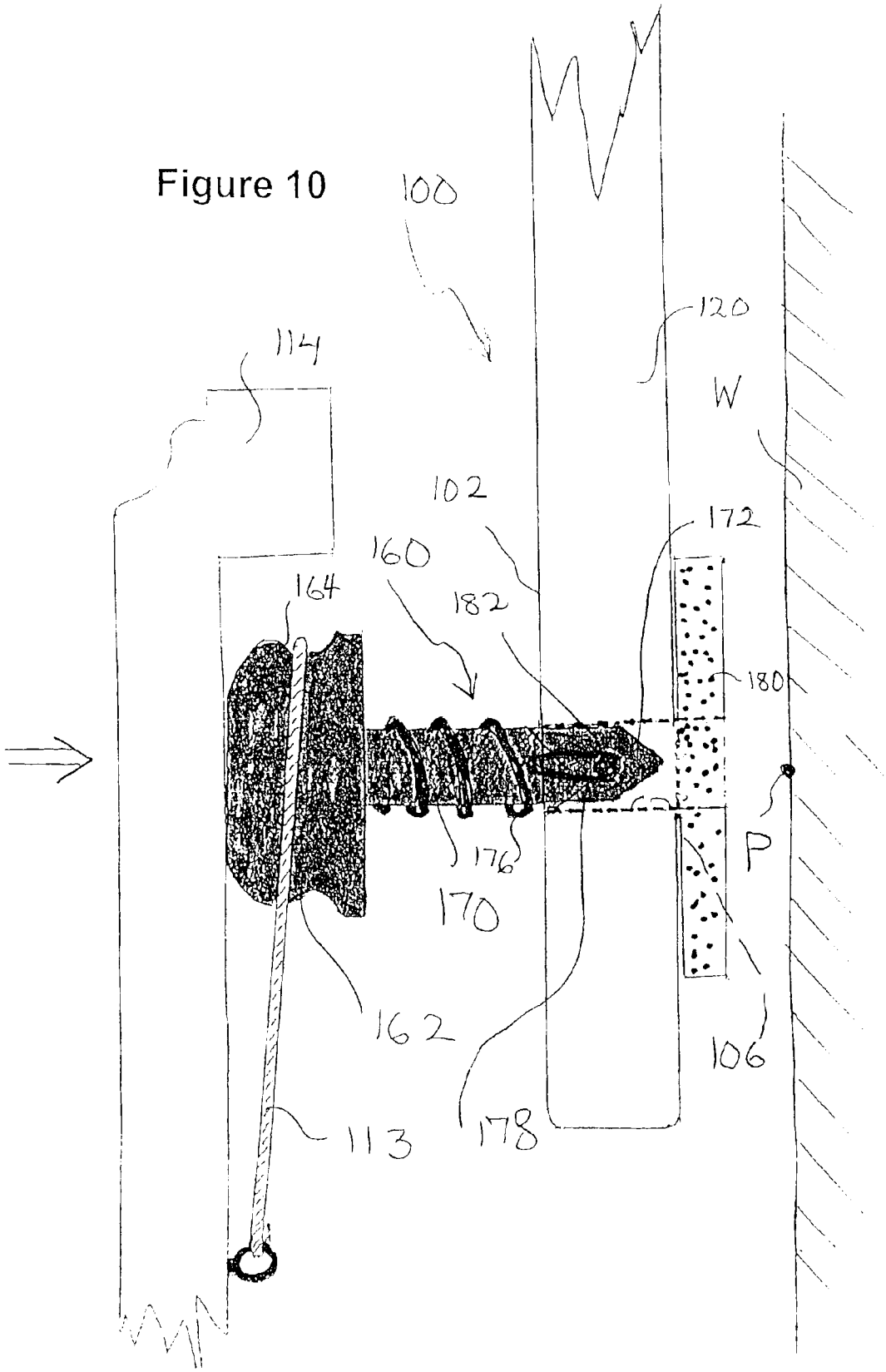
FIG. 10 is a side sectional view, illustrating a relationship between the wall and the locator and a picture frame for the locator of FIG. 9, which is partially illustrated.

With reference to FIGS. 9 and 10, a second embodiment of a locator for use in hanging a picture frame is generally designated by the numeral 100. The locator 100 facilitates a hanging of a picture frame by property locating the proper position for the anchoring fastener which is to be fixed to the wall W or support structure for suspending the frame when only a single anchor point is required.

The locator 100 comprises an elongated arm 120. A rod-like handle 150 projects forwardly from an upper portion of the arm. A suspension/marker assembly 160 is positioned at a generally opposite location of the arm 120 and carried by the arm. The assembly 160 includes a head 162 with a circumferential groove 164, which is contoured to receive a flexible wire hanger 113 of an associated picture frame 114. The head 162 is mounted to a plunger 170 which is partially received in a throughbore 106 of the arm. The spring 176 of the plunger is disposed between the head 162 and the front surface 102 of the arm. The distal end 172 of the plunger is pointed and in a normal mode is retracted within the throughbore 106. Preferably, a soft pad 180 is mounted on the rear surface 104 of the arm and also includes an opening communicating with the throughbore 106. The pad 180 may have a fabric or rubber composition. The plunger 170 includes a slot 178 and a pin 182 extends through an edge of the arm to retain the plunger assembly to the arm. The point may be contacted against a crayon or other similar marking substance to facilitate marking the wall.

As best illustrated in FIG. 10 and described in FIG. 8, the frame 114 is suspended by reception of hanger 113 in the groove 164 and the locator 100 is held via the handle 150. The locator with the suspended picture frame is then moved to the proper position. When the proper positioning is obtained, a light force is applied against the front of the picture frame in the direction of the FIG. 10 arrow to project the point 172 to mark the proper position on the wall W. After the position has been properly marked (not illustrated), the picture frame is then dismounted from the locator 100 and the fastener is positioned at the properly marked point P where, for example, a screw, nail or other hook type fastener may then be mounted to the wall. The picture frame is then suspended from the fastener to accurately replicate the optimum previously marked position.

While a preferred embodiment of the invention has been set forth for the purposes of illustration, the foregoing description should not be deemed a limitation of the invention herein. Accordingly, various adaptations, modifications and alternatives may occur to one skilled in the art without departing from the spirit and the scope of the invention.

What is claimed is:

1. A locator device for locating the proper anchor position for hanging a frame comprising:

a first arm having a first boss for suspending a frame hanger and a first marker positioned in close proximity to said first boss;

a second arm having a second boss for suspending a frame hanger and a second marker positioned in close proximity to said second boss, wherein at least one marker comprises a plunger and has a point which is projectable outwardly from a said boss; and a connector for connecting said arms at a selected fixed angular relationship.

2. The locator device of claim 1, wherein said connector comprises a threaded fastener extending through end locations of said first and second arm.

3. The locator device of claim 2, wherein said connector further comprises a wing nut threadable with said fastener.

4. The locator device of claim 1, further comprising a handle and wherein said connector further connects said handle relative to said arms of the selector in fixed angular relationship.

5. The locator device of claim 4, wherein said handle further comprises a plate-like member defining an opening.

6. The locator device of claim 5, wherein said handle further comprises a second opening and said handle is disposed between said first and second arms and a fastener extends through said arms and said connector comprises a fastener which extends through said arms and said opening and a nut is threadable with said fastener for fixably connecting said handle and said arms.

7. The locator device of claim 1, wherein a said boss further comprises a central throughbore and wherein in a normal mode, said point is retracted within said boss, and in an activated mode, said point extends beyond said boss.

8. The locator device of claim 1, wherein at least one said boss defines a generally arcuate groove.

9. A locator device for locating the proper anchor position for hanging a frame comprising:

a first arm having a first boss for suspending a frame hanger and a first marker comprising a first plunger positioned in close proximity to said first boss, said first marker comprising an end portion projectable beyond said first boss;

a second arm having a second boss for suspending a frame hanger and a second marker comprising a second plunger positioned in close proximity to said second boss, said second marker comprising an end portion projectable beyond said second boss;

a handle; and a connector for connecting said arms and said handle at a selected fixed angular relationship.

10. The locator device of claim 9, wherein one said marker comprises a plunger and has a point which is projectable beyond said boss.

11. The locator device of claim 10, wherein each said marker further mounts a pad on an end opposite said end portion.

12. The locator device of claim 11, wherein each said boss further comprises a central throughbore and each said marker has a distal portion, wherein in a normal mode, said distal portion pointer is retracted within said boss, and in an activated mode, said distal portion extends beyond said boss.

13. A locator device for locating the proper anchor position for hanging a frame comprising:

an elongated arm, having longitudinally spaced first and second positions, said arm defining a bore at said second position;

a handle disposed at said first position; and a suspension/marker assembly disposed at said second position, said assembly comprising a plunger having a marker end and a head for receiving a frame hanger, said plunger including a shank having a longitudinal slot, a spring encircling said shank and engagable against said head and said arm, and a pin extending through said slot and said arm to retain said plunger to said arm.

14. The locator device of claim 13 wherein said handle comprises a rod-like member which projects orthogonally from said arm.

15. The locator device of claim 13 wherein said assembly plunger has opposed first and second ends.

16. The locator device of claim 15 wherein said head is mounted at said first end.

17. The locator device of claim 15 wherein said second end has a pointed configuration.

18. The locator device of claim 17 wherein said arm bore receives a portion of said plunger, said plunger pointed configuration being retracted within said bore in a normal mode and being projectable therefrom to extend beyond said bore.

19. The locator device of claim 18 further comprising a pad mounted to a surface of said arm generally opposite said head.

20. The locator device of claim 13 wherein said head defines a groove.

21. A locator device for locating the proper anchor position for hanging a frame comprising:

a first arm having a first boss for suspending a frame hanger and a first marker positioned in close proximity to said first boss;

a second arm having a second boss for suspending a frame hanger and a second marker positioned in close proximity to said second boss;

a handle; and a connector comprising a threaded fastener extending through end locations of said first and second arms for connecting said arms at a selected first and a second fixed angular relationship, wherein in said first angular relationship said arms are disposed in substantially parallel relationship, and in said second angle relationship said arms are disposed at an acute angle forming a vertex, with said handle extending outwardly from the vertex at an angle which substantially bisects said acute angle.

* * * * *